United States Patent [19]

Kovari et al.

[11] Patent Number: 4,643,024

[45] Date of Patent: Feb. 17, 1987

[54] METHOD OF, AND MEASURING TUBE AND MEASURING PROBE FOR, MEASURING FLUID PRESSURE IN A SEALED BORE HOLE

[75] Inventors: Kalman Kovari, Zollikon; Jakob Köppel, Würenlos, both of Switzerland

[73] Assignee: Gesellschaft zur Förderung der industrieorientierten Forschung an den Schweizerischen Hochschulen und weiteren Institutionen, Zurich, Switzerland

[21] Appl. No.: 799,473

[22] Filed: Nov. 18, 1985

[30] Foreign Application Priority Data

Nov. 21, 1984 [CH] Switzerland ..... 5556/84

[51] Int. Cl.[4] ..... E21B 47/06

[52] U.S. Cl. ..... 73/151; 73/155; 166/250

[58] Field of Search ..... 73/151, 155, 744; 166/250, 191

[56] References Cited

U.S. PATENT DOCUMENTS

| | | | |
|---|---|---|---|
| 2,793,524 | 5/1957 | Badger | 73/155 |
| 2,964,942 | 12/1960 | Reed | 73/155 |
| 3,283,584 | 11/1966 | Coffing | 73/744 |
| 3,974,690 | 8/1976 | Brock, Jr. et al. | 73/151 |
| 4,192,181 | 3/1980 | Patton et al. | 73/155 |
| 4,230,180 | 10/1980 | Patton et al. | 166/185 |
| 4,392,376 | 7/1983 | Lagus et al. | 73/155 |
| 4,480,690 | 11/1984 | Vann | 166/250 |

FOREIGN PATENT DOCUMENTS

| | | | |
|---|---|---|---|
| 1235934 | 6/1971 | United Kingdom | 73/744 |

*Primary Examiner*—Michael J. Tokar
*Assistant Examiner*—Scott M. Oldham
*Attorney, Agent, or Firm*—Werner W. Kleeman

[57] ABSTRACT

A measuring tube is inserted into a bore hole for measuring underground fluid pressure and is sealed against the bore hole wall for limiting the areas or regions in which the pressure measurement is to occur. A measuring cell is inserted into the measuring tube wall in each of these areas or regions and includes a mobile pressure sensing element against which acts the pressure of the medium surrounding the measuring tube. An end of the pressure sensing element projects into the inner space of the measuring tube and, for measurement, a measuring wheel of a measuring probe is brought into position underneath the end of the pressure sensing element such that the latter is moved radially outwards against the pressure exerted on it. The force which thus acts on the measuring wheel is determined by a measuring device for measuring the pressure. The medium to be measured does not enter or leak into the measuring tube since the measuring cell is sealingly inserted into the measuring tube. The measuring wheel is brought very accurately into the measuring position by the rotation of a central portion of the measuring probe relative to the end portions, which are guided on wheels, and the movement of the probe until it makes contact with stops. This is a prerequisite for high precision pressure measurement.

20 Claims, 15 Drawing Figures

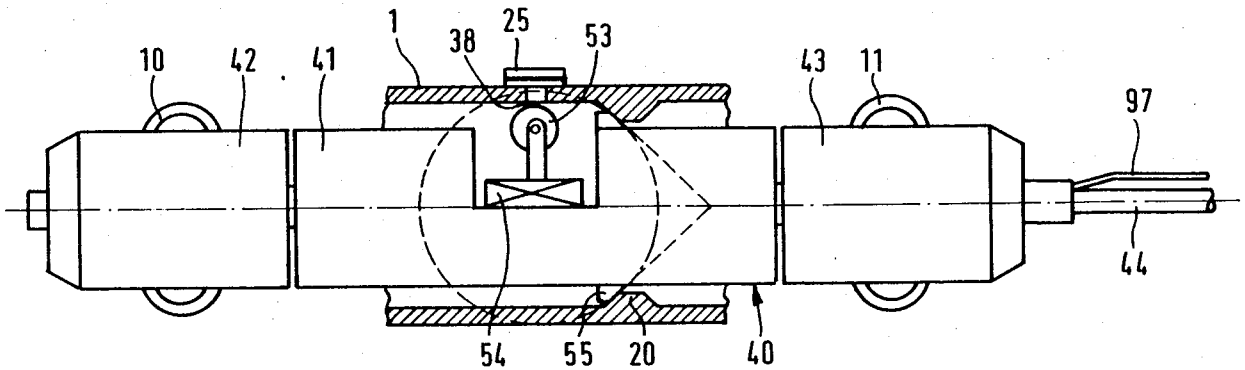
Fig. 4
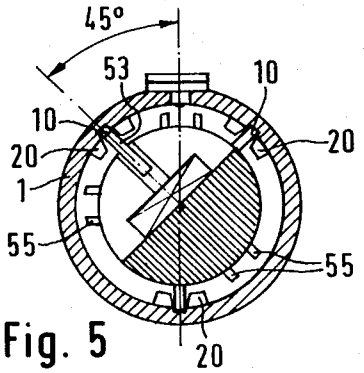
Fig. 6
Fig. 5

METHOD OF, AND MEASURING TUBE AND MEASURING PROBE FOR, MEASURING FLUID PRESSURE IN A SEALED BORE HOLE

CROSS REFERENCE TO RELATED PATENT

This application is related to the commonly assigned U.S. Pat. No. 4,327,590, granted May 4, 1982; and entitled "METHOD AND APPARATUS FOR DETERMINING SHIFTS AT TERRAIN AND IN STRUCTURES".

BACKGROUND OF THE INVENTION

The present invention relates to a new and improved method of measuring fluid pressure i.e. liquid or gas pressure in a sealed bore hole. The present invention also relates to a new and improved construction of a measuring tube for measuring such pressure as well as to a new and improved construction of a measuring probe for such measuring tube.

In its more particular aspects, the present invention specifically relates to a new and improved method for measuring fluid pressure in a sealed bore hole by means of a measuring tube inserted into the bore hole. In given areas or regions of the bore hole where the pressure measurement is to take place and on both sides of each area or region in which the respective measurement is planned, the bore hole is sealed by sealing means which are provided between the bore hole wall and the outer wall of the measuring tube. The measurement takes place by means of a measuring probe whose component, which is designed for such measurement, is placed or arrives at a measuring location provided in the wall of the measuring tube.

A method of this type is known from U.S. Pat. No. 4,192,181, granted Mar. 11, 1980, and U.S. Pat. No. 4,230,180, granted Oct. 28, 1980. The measurement of the pressure takes place, for example, for geophysical investigations, e.g. for tunnel construction, for investigations of the underground or subterranean regions at dams or other constructions or also for determining the lowering of the water table.

According to the prior art method, the measurement of the pressure occurs in that a valve provided in the wall of the measuring tube which is opened by the measuring probe, establishes a connection with an inner chamber of the measuring probe in which the measurement takes place. Because of the transition of the medium to be measured into the measuring probe, it is possible for changes of pressure to take place which lead to a faulty result. Furthermore, it is possible that solid particles can lead to malfunction of the valve mechanism used for this purpose.

SUMMARY OF THE INVENTION

Therefore with the foregoing in mind, it is a primary object of the present invention to provide a new and improved method of measuring fluid pressure in a sealed bore hole and which does not exhibit the aforementioned drawbacks and shortcomings of the prior art constructions.

A further important object of the present invention aims at providing a method of measuring fluid pressure which renders possible a high precision of measurement without having the medium to be measured entering into the measuring tube.

Now in order to implement these and still further objects of the invention, which will become more readily apparent as the description proceeds, the method of the present development is manifested by the features that the measurement of the pressure is achieved by measuring the force necessary to move a pressure receiving component or sensing element by means of the measuring probe inserted into the measuring tube. The pressure receiving component or sensing element is movably and sealingly mounted in the wall of the measuring tube and is loaded by the pressure which is effective on the outside of the measurement tube.

As alluded to above, the present invention is not only concerned with the aforementioned method aspects but also relates to a new and improved measuring tube for carrying out such method. Such measuring tube is of the type containing externally mounted sealing means or devices for providing a sealing connection with the surrounding bore hole wall, and a measuring location located between at least two sealing means or devices serially arranged in lengthwise direction of the measuring tube.

More specifically, the inventive measuring tube contains a measuring cell which is sealingly inserted into an opening in the measuring tube wall at the measuring location. A housing of the measuring cell encases a pressure-receiving component or sensing element which is movably arranged in the housing and which is acted upon by the pressure of the medium surrounding the measuring tube. An inner space of the housing is sealed against the space which surrounds the measuring tube, by means of a seal which is movable conjointly with the pressure-receiving component or sensing element.

As further alluded to above, the present invention is not only concerned with the aforementioned measuring tube aspects but also relates to a new and improved measuring probe which is used in combination with such measuring tube and which is of the type containing guide wheels.

More specifically, the inventive measuring probe contains a measuring device or means provided with a contact element or measuring wheel which makes a measuring contact with the pressure-receiving component or sensing element of the measuring tube. The measuring means is provided with means for measuring the force required for moving the pressure-receiving component or sensing element against the pressure exerted by the medium surrounding the measuring tube and which pressure is to be measured.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

Figure 1:
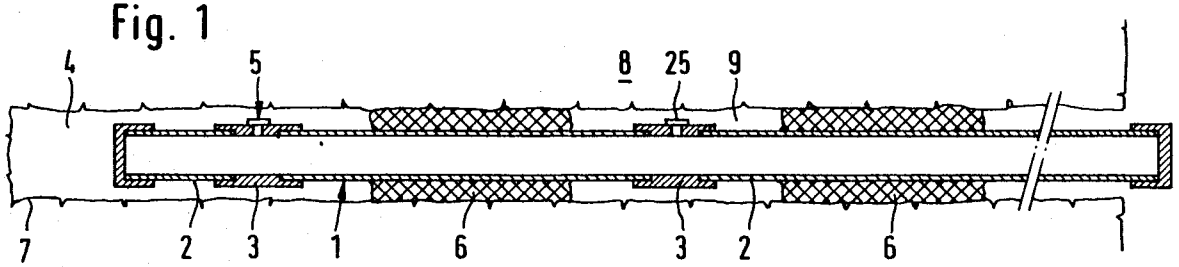
FIG. 1 is a schematic illustration of an axial section of a portion of a first exemplary embodiment of the inventive measuring tube for measuring fluid pressure and mounted in a bore hole.
Figure 7:
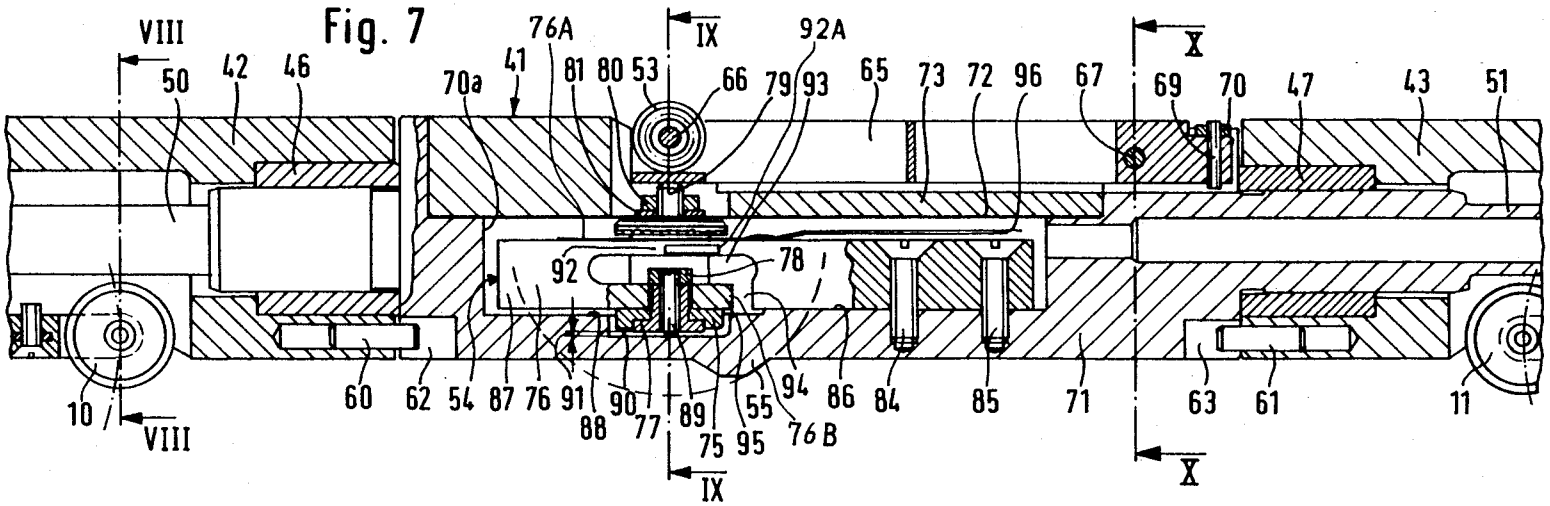
Figure 10:
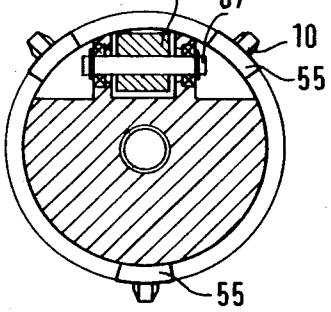
Figure 9:
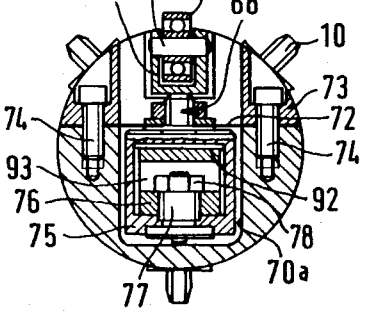
Figure 8:
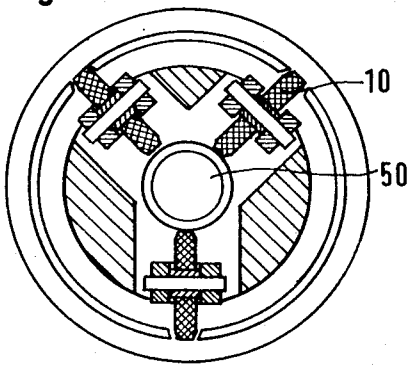
Figure 11:
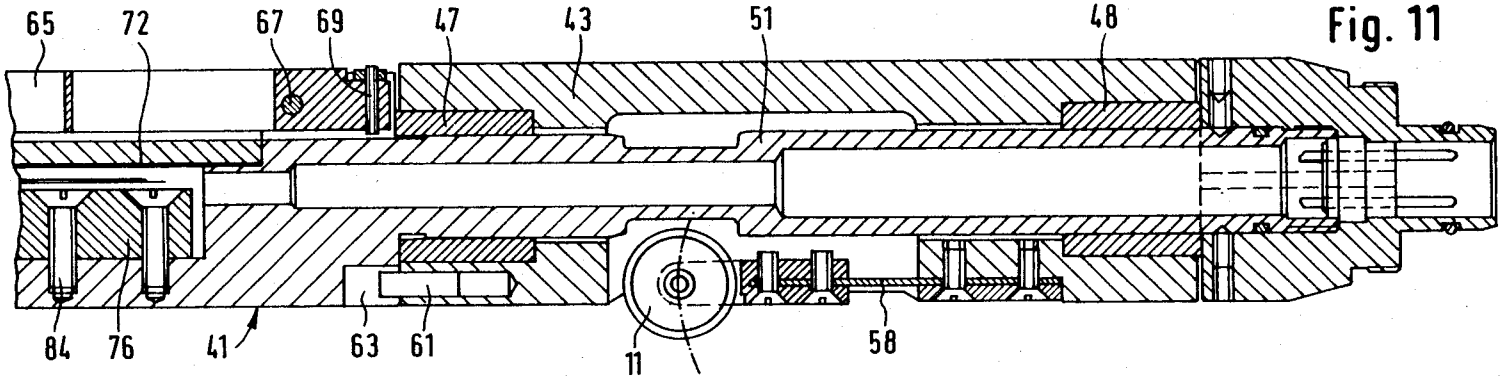
Figure 12:
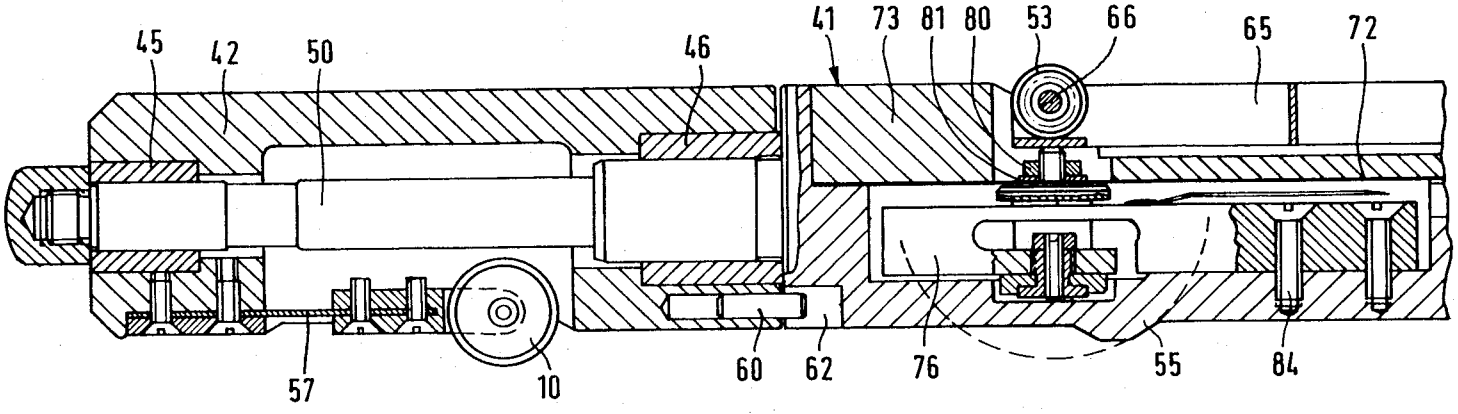
Figure 13:
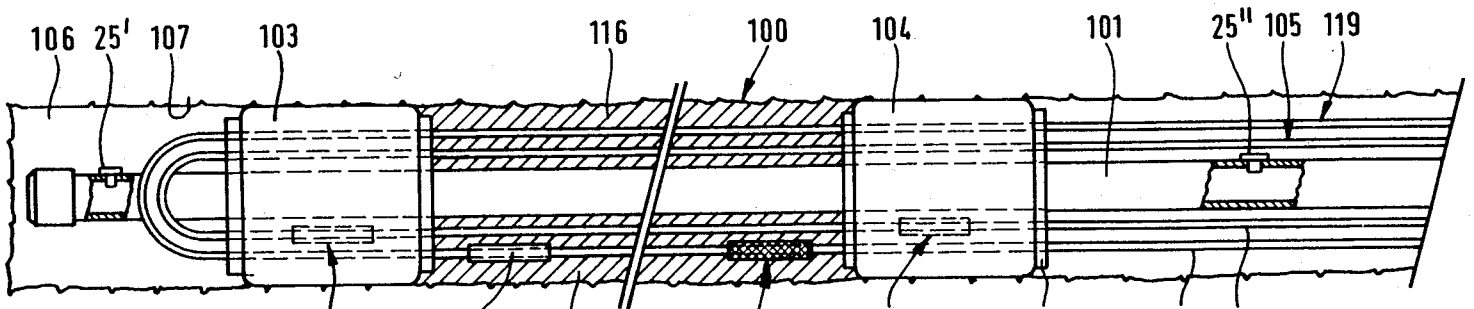
Figure 15:
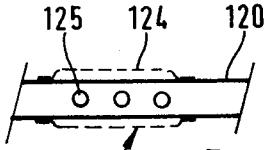
Figure 14:
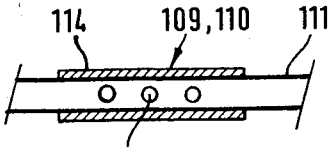

FIG. 4 shows a schematic side view of a measuring probe with a portion of the measuring tube in accordance with FIG. 1;

FIG. 5 shows a cross-section through the measuring probe in accordance with FIG. 4 in a travelling position relative to the measuring tube;

FIG. 6 shows a cross-section through the measuring probe in accordance with FIG. 4 in a measuring position relative to the measuring tube;

FIG. 7 shows an axial section through the middle or central portion of the measuring probe in accordance with FIG. 4;

FIG. 8 shows a cross-section along the line VIII—VIII of FIG. 7;

FIG. 9 shows a cross-section along the line IX—IX of FIG. 7;

FIG. 10 shows a cross-section along the line X—X of FIG. 7;

FIG. 11 shows an axial partial section of the rear end of the measuring probe in accordance with FIG. 4;

FIG. 12 shows an axial partial section through the front end of the measuring probe in accordance with FIG. 4;

FIG. 13 shows a schematic illustration of a portion of a second exemplary embodiment of the inventive measuring tube mounted in a bore hole and provided with a sealing device;

FIG. 14 shows a cross-section through a filling valve mechanism used in combination with the measuring tube shown in FIG. 13; and FIG. 15 shows a cross-section through an exhaust or venting mechanism used in combination with the measuring tube shown in FIG. 13.

DETAILED DESCRIPTION OF THE PREFERRED EMBODIMENTS

Describing now the drawings, it is to be understood that to simplify the showing thereof, only enough of the apparatus for measuring fluid pressure in a sealed bore hole has been illustrated therein as is needed to enable one skilled in the art to readily understand the underlying principles and concepts of the present invention. Turning now specifically to the drawings, a first exemplary embodiment of the inventive measuring tube 1 will be seen to comprise serially arranged individual tubular pieces 2 and connecting couplings or coupling sleeves 3 interconnecting the tubular pieces 2. This arrangement is such that by continuous joining of the tubular couplings or coupling sleeves 3 and the tubular pieces 2 and conjointly therewith further inserting the resulting measuring tube 1 into the bore hole 4, such measuring tube 1 can be assembled to achieve a desired length with a corresponding number of measuring locations 5 provided in the tubular couplings or coupling sleeves 3.

A sealing means or collar 6 is fastened to the outside of the tubular piece 2 in a not here further described manner. A not particularly illustrated filling conduit connects the sealing means or collars 6 of the tubular pieces 2 with each other. This filling conduit allows the sealing means or collars 6 to be placed under pressure by supplying a rheological fluid medium, for example, gas, water or cement mortar. Thus, the sealing means or collars 6 can be fixedly and therefore sealingly placed against the bore hole wall 7 of the bore hole 4. In this manner, each measuring location 5 is enclosed between two sealing means or collars 6 so that at the measuring location 5, the pressure existing in this enclosed area or region can be measured. This pressure can be formed by gas or liquid which has seeped or penetrated from the surrounding material 8 into the space 9 between the measuring tube 1 and the bore hole wall 7.

Figure 2:
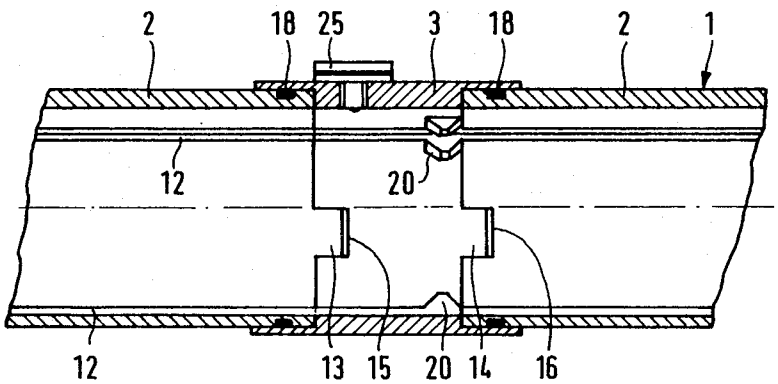
FIG. 2 shows an axial sectional view of the measuring tube in accordance with FIG. 1, in the region of a measuring position.

For the guidance of wheels or guide wheels 10 and 11 of a measuring probe 40 illustrated in FIGS. 4 to 12, the individual tubular pieces 2 and the tubular couplings or coupling sleeves 3 possess guide grooves 12 which extend axially parallel to the measuring tube 1 at angular distances of about 120° from each other. The tubular couplings or coupling sleeves 3 and the tubular pieces 2 have to be mounted in a predetermined angular position relative to each other to ensure that the guide grooves 12 of the tubular pieces 2 and the tubular couplings or coupling sleeves 3 can merge with each other. For this purpose, a form-locking engagement is provided between the tubular pieces 2 and the tubular couplings or coupling sleeves 3 as illustrated, for example, in FIG. 2 by extensions 13 and 14 which are formed in one of the two parts and engage correspondingly formed recesses 15 and 16 of the other part. It is to be understood that such a form-locking connection can be achieved in various ways as also can be the securing of the position of the components with respect to each other in axial direction by means of radially or tangentially extending screws or bolts which extend through both parts to be interconnected. However, the connection has to occur such that the measuring tube 1 is fluid tight. In accordance with FIG. 2, an O-ring 18 is placed in each circumferential groove of the tubular piece 2 such that the tubular coupling or coupling sleeve 3, which surrounds the tubular piece 2, sealingly engages with its inner wall the O-ring 18.

Furthermore, stop lugs 20 are provided on the inside of the tubular couplings or coupling sleeves 3 next to each guide groove 12. These stop lugs 20 serve for the exact positioning of the measuring probe 40 in its measuring position as will be further described hereinbelow.

A threaded hole 22 is provided at the measuring location 5 of the tubular coupling or coupling sleeve 3 and a threaded connector 23 of a housing 24 of the measuring cell 25 is threadably connected with the threaded hole 22. An O-ring 26 placed between the measuring cell housing 24 and the tubular coupling or coupling sleeve 3, ensures sealing of the measuring tube 1.

A piston 27 constructed as a pressure receiving component or sensing element is movably mounted in the measuring cell 25 and a plunger, i.e. a piston rod or stem 28 of the piston 27 is guided in an axial ball bearing 29 in the threaded connector 23 of the housing 24. The inner space of the housing 24 which accommodates the piston 27 is sealed towards the outside, i.e. against the space 9 in which prevails the pressure to be measured, by means of a thin, highly elastic seal or membrane 30. The outer end face of the piston 27 makes contact with this seal or membrane 30 or is fastened thereto, for instance, by adhesive bonding. The pressure acting upon the seal or membrane 30 is consequently transferred to the piston 27 such that the underside of the piston 27 comes to bear upon an inner shoulder 32 of the housing 24. Only a very short piston travel 33 is necessary for the measurement of the pressure.

Figure 3:
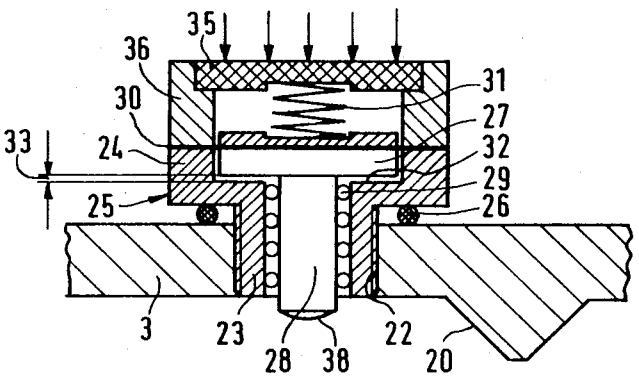
FIG. 3 shows a cross-section through a measuring cell of the measuring tube in accordance with FIG. 1 and enlarged in relation to the illustration of FIGS. 1 and 2.

The seal or membrane 30 is covered at a very small distance therefrom by a protecting or protective filter plate 35 which is inserted into a housing cover 36 which holds the seal or membrane 30 at the housing 24. The unit comprising the piston 27 and the seal or membrane 30 is pre-loaded or biased in the direction of the inner space of the measuring tube 1 by means of a compression spring 31 in order to permit the measurement of a lower pressure on the outside relative to the pressure existing inside the measuring tube 1, which normally is atmospheric pressure. The pressure acting upon the inside of the seal or membrane 30 is therefore compensated by this compression spring 31. According to the illustration in FIG. 3, the compression spring 31, for example, is clamped between the protective filter plate 35 and a cover plate 34 engaging the seal or membrane 30. For measuring higher pressures, the compression spring 31 can be dispensed with.

The free end of the piston rod or stem 28 projects by a small extent into the inner space of the tubular coupling or coupling sleeve 3 and possesses a rounded dome 38 which is intended for providing the mechanical measuring contact with the measuring probe 40 to be described in further detail in the following.

The measuring probe 40 is constructed as an elongate cylindrical body with a middle or central portion 41. The middle or central portion 41 is rotatable about a longitudinal axis of the measuring probe 40 relative to end portions 42 and 43 which are guided by the wheels or guide wheels 10 and 11. The mutual mounting of the middle or central portion 41 and the end portions 42 and 43 of the measuring probe 40 is achieved by means of pairs of slide bearings 45, 46 and 47, 48 (cf. FIGS. 11 and 12) which are provided at the related inner and outer ends of the end portions 42 and 43. The slide bearings 45, 46 and 47, 48 support related elongate axial shafts 50 and 51 which are formed at the associated outer ends of the middle or central portion 41 of the measuring probe 40. The axial shaft 51 which is enclosed by the front end portion 43 of the measuring probe 40, also serves as an operating rod for turning or rotating the middle or central portion 41 of the measuring probe 40 into or out of the measuring position. This axial shaft 51 is bored-through or hollowed-out along its length such as to accommodate not particularly shown connecting cables leading to a measuring means or device 54 provided in the middle or central portion 41 of the measuring probe 40. The turning or rotating movement is performed, for example, through an angle of approximately 45° between the positions shown in FIGS. 5 and 6.

In the travel position depicted in FIG. 5, a contact element or measuring wheel 53 of the measuring device or means 54, is located in an axial direction behind the guide wheel or wheel 10. However, the outer circumference of the contact element or measuring wheel 53 is arranged at a small distance from the wall of the measuring tube 1 and therefore does not engage the guide groove 12. The above-mentioned stop lugs 20 of the measuring tube 1 are each arranged on a respective side of the guide grooves 12, so that the measuring probe 40 can be unobstructedly displaced in the measuring tube 1 when the middle or central portion 41 assumes the travel position illustrated in FIG. 5.

When the contact element or measuring wheel 53 of the measuring device or means 54 passes the side of the rounded dome 38 of the piston 27 of the measuring cell 25 at the angular distance of 45°, and when correspondingly the counter stops 55, which are provided at the middle or central portion 41, pass the stop lugs 20 of the measuring tube 1, then the middle or central portion 41 is rotated by about 45° into the angular position illustrated in FIG. 6. The measuring probe 40 is then returned until the counter stops 55 arrive at exact engagement with the stop lugs 20, as is schematically illustrated in FIG. 4.

The exact engagement with the stop lugs 20 and therefore the exact alignment of the measuring probe 40 with the measuring tube 1 is ensured by means of the spherical construction of the counter contact surfaces formed at the counter stops 55 and the conical construction of contact surfaces formed at the stop lugs 20. The wheels or guide wheels 10 and 11 also assist in the accurate alignment of the measuring probe 40 and support the measuring probe 40 with a comparatively precisely adjusted bias in the guide grooves 12 of the measuring tube 1. This bias or spring bias is realized by mounting each of the wheels or guide wheels 10 and 11 at the ends of respective leaf or blade springs 57 and 58 as illustrated in FIGS. 11 and 12. The exact engagement or contact position in the rotary direction is ensured by means of contact bolts or pins 60 and 61 which are axially parallelly fixed in the related end portions 42 and 43 and engage in related circumferential grooves 62 and 63 of the middle or central portion 41 of the measuring probe 40. Each of the circumferential grooves 62 and 63 has opposite end surfaces as seen in the circumferential direction of the measuring probe 40. These end surfaces form stop surfaces for the related contact bolts or pins 60 and 61.

During the aforementioned return movement into the engagement or contact position, the contact element or measuring wheel 53 therefore moves underneath the rounded dome 38 of the piston rod or stem 28 and pushes outward, by a small amount relative to the measuring tube 1, the piston 27 which forms the pressure receiving component or sensing element of the measuring cell 25. During this movement, the measuring device or means 54 of the measuring probe 40 measures the force required therefor, i.e. the force necessary to maintain the piston 27, against the environmental pressure which acts upon its outside, out of engagement with the shoulder 32 of the housing 24 of the measuring cell 25. The contact element or measuring wheel 53 is mounted or journaled on an axle or shaft 66 fastened to the end of a lever 65 which extends parallel to the lengthwise axis of the measuring probe 40 and which is pivotable about a shaft 67 relative to the measuring probe 40. It is thereby achieved that the measuring wheel 53 when travelling under the measuring piston or piston 27, only moves substantially radially with respect to the measuring probe 40 or the measuring tube 1 and transmits the measuring force only in this direction to the measuring device or means 54. The pivot range of the lever 65 is very limited because the end of the lever 65 which carries the contact element or measuring wheel 53, abuts a transmitting member or force transmitting member 68 of the measuring device or means 54 and an impact bolt 69 is provided at the opposite end of the lever 65. The impact bolt 69 which is constructed as a threaded bolt with a locknut 70, so that the pivot range of the lever 65 can be radially outwardly adjusted.

The turning or rotating movement of the contact element or measuring wheel 53 when travelling under the piston 27, and the pivoting movement of the lever 65 are also freely rotatable due to a corresponding construction of the related mountings. This is also true for the piston 27 which is easily movable due to its mounting in the axial ball bearing 29.

The measuring device or means 54 is arranged in a longitudinally directed and cross-sectionally approximately square recess 70*a* of a solid main body 71 of the middle or central portion 41 of the measuring probe 40. This recess 70*a* is closed by a membrane 72 which is held at the main body 71 by means of a closure body 73 using bolts 74. The transmitting member 68 forms a closed frame 75 which is arranged in the recess 70*a*. The closed frame 75 encloses a measuring beam 76 and is fixedly connected with this measuring beam 76 by means of a bolt 77 and a locknut 78.

A threaded bolt 79 is fixed at the outside of the closed frame 75 of the transmitting member 68 and extends through an opening in the membrane 72 up to the end of the lever 65 which supports the contact element or measuring wheel 53. As a result, the transmitting member 68 can transmit the movement of the lever 65 or the deflection of the contact element or measuring wheel 53 to the measuring beam 76. A nut 80 is threaded or screwed onto the threaded bolt 79 and sealingly presses a washer 81, which encircles the threaded bolt 79, against the membrane 72 such that this membrane 72 is clamped between the closed frame 75 and this washer 81.

One end of the measuring beam 76 is tightly fixed by means of two bolts 84 and 85 to the solid main body 71 of the measuring probe 40 in such a manner that this end of the measuring beam 76 fixedly bears upon a raised bottom portion 86 of the recess 70*a*. The remaining portion of the measuring beam 76, for example, starting substantially from its center, is located at a small distance above a lowered or offset bottom portion 88 of the recess 70*a*. Consequently, the measuring beam 76 is bendable or deflectable due to the measuring movement of the transmitting member 68 which is fixedly connected with the measuring beam 76. An adjustment screw 89 which forms a stop, limits the bending or deflecting movement of the measuring beam 76. The adjustment screw 89 is enclosed by the bolt 77 which connects the measuring beam 76 with the frame 75 of the transmitting member 68. At maximum bending or deflection of the measuring beam 76, the end of the adjustment screw 89 comes to engage a bottom recess 90 formed in the recess 70*a*. This bottom recess 90 is provided for accommodating the bottom portion of the closed frame 75 which encloses the measuring beam 76. For example, a play or gap 91 of about 0.3 mm is set by adjustment of the adjustment screw 89.

The force measurement by means of the measuring beam 76 is achieved by determining its bending or deflecting deformation. This is achieved by externally mounting strain gauges 92A at one arm 76A of the measuring beam 76 in a specific bending or deflecting area or region 92 of the measuring beam 76. The strain gauges 92A are subject to changes in their electrical resistance under the action of strain. A suitable arrangement of the strain gauges 92A and their electrical circuit connection in the form of a Wheatstone bridge circuit enables high measuring precision. The area or region 92 of the measuring beam 76, where the bending or deflecting deformation or movement is measured, possesses a substantial cross-sectional weakening due to a cut-out 93 which extends in the longitudinal direction of the measuring beam 76 and which has an outward opening 94 at an end opposite to an outer free end 87 of the measuring beam 76. The cut-out 93 separates the one arm 76A from an other arm 76B of the measuring beam 76. Consequently, the measuring beam 76 possesses an inwardly directed or inner free end 95 at the other arm 76B and which extends parallel to the bending or deflecting area or region 92 of the one arm 76A. The closed frame 75 of the transmitting member 68 is affixed to this free end 95 or the other arm 76B in the manner mentioned hereinbefore. Consequently, the bending or deflecting deformation of this inwardly directed free end 95 is transmitted via the outer free end 87 of the measuring beam 76 to the bending or deflecting area or region 92.

An electrical cable which leads to the outside through the axial shaft 51, is designated by the reference numeral 96 and connects the strain gauges 92A with an electrical measuring instrument arranged on the outside. A portion of a cable 97 leading from the measuring probe 40 to the outside, is also shown in FIG. 4.

It will be understood that the force measuring arrangement described hereinbefore can also be constructed differently. For example, instead of the measuring beam 76 provided with strain gauges 92A, commercially available force sensors can be used which convert a measuring movement against the constant force of a spring element into an electrical measuring signal according to an ohmic resistive, capacitive, inductive or piezo-electric measuring principle.

FIG. 13 shows a second exemplary embodiment of the inventive measuring tube containing a sealing device 100. Compared to the use of the sealing means or collar 6 according to the illustration in FIG. 1, the sealing device 100 insures a more reliable and more complete sealing of the area or region in which the pressure measurement is intended. This is of great importance for a precise determination of the pressure in this area or region.

The sealing device 100 comprises a pair of sealing sleeves or collars 103 and 104 which are sealingly fixed to the outside of a measuring tube 101 via related flanges 102. The sealing sleeves or collars 103 and 104 are filled with a hardening filling medium, for example, cement mortar from outside a bore hole 106 by means of a filling conduit or line 105 in such a manner that they sealingly engage the bore hole wall 107. During this operation, the filling medium flows into the sealing sleeves or collars 103 and 104 through related filling valve mechanisms 109 and 110 which are clearly shown in FIG. 14 and which are placed inside the sealing sleeves or collars 103 and 104. Each filling valve mechanism 109 or 110 possesses a rubber elastic hose piece 114 which encircles a return conduit or line 111 and thereby a number of holes 113 provided therein. There is thus prevented a return flow into the return conduit or line 111.

The filled sealing sleeves or collars 103 and 104 between them seal off an enclosure or space 116 which subsequently is also filled, for instance, by a hardening filling medium 117. Since this latter filling medium 117 comes into immediate contact with the possibly uneven bore hole wall 107, there is achieved a sealing which is substantially improved when compared with the sealing merely achieved by the contact pressure of the sealing sleeve or collar 103 or 104.

A second filling conduit or line 119 with a return conduit or line 120 is provided for filling the enclosure or space 116. The return conduit or line 120 possesses inside the enclosure or space 116, a filling valve mechanism 122 which is constructed in the same manner as that already described in connection with FIG. 14. Furthermore, the return conduit or line 120 possesses a venting mechanism 123 containing a fabric sleeve or collar 124 fixed to the return conduit or line 120. The fabric sleeve or collar 124 surrounds a number of holes 125 in the return conduit or line 120 and permits the flow of air and/or water from the enclosure or space 116 to the return conduit or line 120 but holds back the filling medium 117 in the enclosure or space 116.

It will be understood that, with the exception of the measuring cell 25' which is provided at the end of the measuring tube 101, a sealing device 100 of the type described hereinbefore is provided in the longitudinal direction of the measuring tube 101 on each side of a measuring cell 25''.

While there are shown and described present preferred embodiments of the invention, it is to be distinctly understood that the invention is not limited thereto, but may be otherwise variously embodied and practiced within the scope of the following claims. Accordingly,

What we claim is:

1. A method of measuring fluid pressure in a bore hole bounded by a bore hole wall and comprising the steps of:

inserting into said bore hole a measuring tube defining both a measuring tube wall and at least one measuring location at which a pressure sensing element is movably and sealingly supported in said measuring tuble wall;

sealing at least one predetermined region of said bore hole on two sides of said at least one predetermined region by placing sealing means between said measuring tube and said bore hole wall;

introducing into said measuring tube a measuring probe containing measuring means constructed for measuring the fluid pressure acting upon said pressure sensing element in said bore hole;

during said step of introducing said measuring probe into said measuring tube, placing said measuring portion of said measuring probe at said at least one measuring location provided in said measuring tube wall;

measuring said fluid pressure in said at least one predetermined region by means of said measuring probe placed at said at least one measuring location; and said step of measuring said fluid pressure entailing measuring the force which is applied to said measuring probe by said pressure sensing element transverse to said measuring tube wall due to said fluid pressure prevailing in said at least one predetermined region of said bore hole on the outside of said measuring tube.

2. A measuring tube for measuring fluid pressure in a bore hole bounded by a bore hole wall, comprising:

sealing means for providing sealing connections between said measuring tube and said bore hole wall;

said sealing means containing at least two sealing devices series-arranged in lengthwise direction at the outside of said measuring tube;

at least one measuring location defined by said measuring tube and placed between said at least two sealing devices;

a measuring cell containing a housing with an inner space;

said measuring cell being sealingly inserted at said at least one measuring location into an opening in a wall defined by said measuring tube;

a pressure sensing element movable transverse to said wall and responsive to pressure generated by a fluid medium surrounding said measuring tube for generating a force proportional to said pressure and enclosed by said housing of said measuring cell;

a seal movable conjointly with said pressure sensing element; and said seal sealing said inner space of said housing against the space surrounding said measuring tube.

3. The measuring tube as defined in claim 2, wherein:

said seal sealing said inner space of said housing of said measuring cell is constituted by a membrane.

4. A measuring tube for measuring fluid pressure in a bore hole bounded by a bore hole wall, comprising:

sealing means for providing sealing connections between said measuring tube and said bore hole wall;

said sealing means containing at least two sealing devices series-arranged in lengthwise direction at the outside of said measuring tube;

at least one measuring location defined by said measuring tube and placed between said at least two sealing devices;

a measuring cell containing a housing with an inner space;

said measuring cell being sealingly inserted at said at least one measuring location into an opening in a wall defined by said measuring tube;

movable pressure sensing element responsive to pressure generated by a fluid medium surrounding said measuring tube and enclosed by said housing of said measuring cell;

a seal movable conjointly with said pressure sensing element;

said seal sealing said inner space of said housing against the space surrounding said measuring tube;

said pressure sensing element constituting a piston having a piston rod;

said housing containing a connector which is inserted into said opening in said wall defined by said measuring tube;

said piston rod of said piston constituting said pressure sensing element being axially movable in said connector of said housing; and said piston rod defining a free end which projects into said measuring tube.

5. The measuring tube as defined in claim 4, further including:

an axial ball bearing; and said axial ball bearing guiding said piston rod in said connector of said housing of said measuring cell.

6. The measuring tube as defined in claim 2, further including:

a filter plate; and said filter plate closing said housing of said measuring cell toward the outside.

7. The measuring tube as defined in claim 2, further including:

a compression spring acting in an effective direction of said fluid medium surrounding said measuring tube; and said compression spring biasing said pressure sensing element enclosed by said housing of said measuring cell.

8. The measuring tube as defined in claim 7, further including:

a filter plate;

said filter plate closing said housing of said measuring cell toward the outside; and said compression spring being clamped between said filter plate and said pressure sensing element.

9. The measuring tube as defined in claim 2, further including:

at least one guide groove provided in the wall defined by said measuring tube;

said measuring tube defining an axis;

said at least one guide groove extending substantially parallel to said axis defined by said measuring tube;

at least one stop lug provided in said measuring tube;

a measuring probe displaceable in said measuring tube; and said at least one stop lug which is provided in said measuring tube serving for positioning said measuring probe relative to said measuring location of said measuring tube.

10. A measuring probe movable in a measuring tube towards a predetermined pressure sensing element provided in said measuring tube for measuring fluid pressure exerted by a fluid medium which surrounds said measuring tube in a bore hole, said measuring probe comprising:

guide wheels;

measuring means containing a contact element for making a measuring contact with said predetermined pressure sensing element provided in said measuring tube; and said measuring means being provided with force measuring means for measuring the force required for moving said pressure sensing element against said fluid pressure to be measured and exerted by said fluid medium surrounding said measuring tube.

11. The measuring probe as defined in claim 10, wherein:

said contact element constitutes a measuring wheel.

12. The measuring probe as defined in claim 11, further including:

a pivot lever having a predetermined end;

said measuring probe defining a lengthwise axis;

said pivot lever extending substantially parallel to said lengthwise axis defined by said measuring probe; and said measuring wheel being mounted at said predetermined end of said pivot lever extending substantially parallel to the longitudinal axis defined by said measuring probe.

13. The measuring probe as defined in claim 10, further including:

a force transmitting member;

said force measuring means containing a measuring beam;

said measuring probe defining a lengthwise axis and a main body;

said measuring beam extending substantially parallel to said lengthwise axis defined by said measuring probe and being rigidly fixed with one of its sides to the main body of said measuring probe;

said force transmitting member connecting said measuring beam with said contact element of said measuring probe;

at least one strain gauge; and said at least one strain gauge being fastened to said measuring beam for measuring said force required for moving said pressure sensing element against said fluid pressure to be measured and exerted by said fluid medium surrounding said measuring tube.

14. The measuring probe as defined in claim 13, wherein:

said measuring beam possesses a free end and two arms extending substantially parallel to each other;

said two arms being connected by means of said free end of said measuring beam;

one of said two arms of said measuring beam facing said contact element;

said strain gauges being fastened to said one arm of said measuring beam; and an other one of said two arms of said measuring beam being connected with said force transmitting member.

15. The measuring probe as defined in claim 13, further comprising:

an adjustment screw; and said adjustment screw limiting bending movements carried out by said measuring beam as a result of measuring said force required for moving said pressure sensing element against said fluid pressure to be measured and exerted by said fluid medium surrounding said measuring tube.

16. The measuring probe as defined in claim 13, further including:

a central portion containing a recess;

said measuring beam being arranged in said recess contained in said central portion;

a membrane closing said recess contained in said central portion; and said force transmitting member extending through said membrane.

17. The measuring probe as defined in claim 13, wherein:

said force transmitting member possesses a frame enclosing said measuring beam.

18. The measuring probe as defined in claim 10, wherein:

said measuring probe has two end portions and a central portion therebetween;

said guide wheels being provided at said two end portions of said measuring probe;

said central portion of said measuring probe carrying said measuring means;

said measuring probe defining a lengthwise axis;

said central portion of said measuring probe being rotatable about said lengthwise axis defined by said measuring probe by a limited rotational angle relative to said two end portions and between a travelling position and a measuring position of said central portion of said measuring probe;

said central portion of said measuring probe possessing on its outside at least one counter stop which determines said measuring position with respect to a longitudinal direction of said measuring tube and which contacts a predetermined stop lug provided at said measuring tube.

19. The measuring probe as defined in claim 18, wherein:

said counter stop possesses a counter contact surface for contacting a contact surface formed at said stop lug.

20. The measuring probe as defined in claim 19, wherein:

one of said contact surface and said counter contact surface constitutes a substantially spherical surface;

an other one of said contact surface and said counter contact surface constitutes a substantially conical surface; and a spherical-conical contact being formed between said counter stop on the outside of said central portion of said measuring probe and said stop lug provided at said measuring tube in said measuring position of said measuring probe.

* * * * *